US009180698B2

(12) United States Patent
Arai

(10) Patent No.: US 9,180,698 B2
(45) Date of Patent: Nov. 10, 2015

(54) PRINTER SYSTEM, INKJET PRINTER, AND COMPUTER-READABLE RECORDING MEDIUM CONTAINING PROGRAM THEREFOR

(71) Applicant: BROTHER KOGYO KABUSHIKI KAISHA, Aichi (JP)

(72) Inventor: Yusuke Arai, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/674,030

(22) Filed: Mar. 31, 2015

(65) Prior Publication Data

US 2015/0273901 A1 Oct. 1, 2015

(30) Foreign Application Priority Data

Mar. 31, 2014 (JP) ..... 2014-071042

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC ..... B41J 11/0095; B41J 13/0027; B41J 2002/17569; B41J 11/42; B41J 2/04505; B41J 13/103; B41J 13/106
See application file for complete search history.

(56) References Cited

U.S. PATENT DOCUMENTS 8,235,492 B2 * 8/2012 Saito et al. ..... 347/16
8,657,436 B2 * 2/2014 Noguchi et al. ..... 347/104
8,820,876 B2 * 9/2014 Hoshi et al. ..... 347/16

FOREIGN PATENT DOCUMENTS

JP 2004-090316 A 3/2004

OTHER PUBLICATIONS

U.S. Appl. No. 14/561,294, filed Dec. 5, 2014.

* cited by examiner

*Primary Examiner* — Lamson Nguyen
(74) *Attorney, Agent, or Firm* — Scully, Scott, Murphy & Presser, PC

(57) ABSTRACT

A printer system has an information processing device and an inkjet printer. The image processing device has a first controller which generates margin information, and transmits the image data and the margin information to the inkjet printer. The inkjet printer has a second controller which obtains the image data and the margin information from the information processing device, causes the conveyor to convey the sheet until the sheet reaches a position where an area on which an image is to be printed firstly faces the printing head, causes the printing head to eject ink drops, and in response to the margin width being less than a threshold width, detect an actual position of the sheet after the cueing process is finished. The second controller causes the printing head to eject ink drops based on the actual position after the detecting process is executed.

16 Claims, 11 Drawing Sheets

PRINTER SYSTEM, INKJET PRINTER, AND COMPUTER-READABLE RECORDING MEDIUM CONTAINING PROGRAM THEREFOR

CROSS-REFERENCE TO RELATED APPLICATION

This application claims priority under 35 U.S.C. §119 from Japanese Patent Applications No. 2014-071042 filed on Mar. 31, 2014. The entire subject matter of the application is incorporated herein by reference.

BACKGROUND

1. Technical Field

The present disclosures relate to an inkjet printer and a computer-readable recording medium storing a program for such an inkjet printer.

2. Related Art

Conventionally, there has been known an inkjet printer configured to eject ink drops onto a recording medium (e.g., a printing sheet), which is being conveyed, to form an image thereon. Such an inkjet printer is generally provided with a printing head configured to eject ink drops, a sensor configured to output a detection signal representing presence/absence of the recording medium, and a carriage mounting the printing head and the sensor thereon and configured to be movable in a scanning direction which is orthogonal to a conveying direction of the recording medium.

SUMMARY

A printer system includes an information processing device and an inkjet printer. The information processing device has a first controller, while the inkjet printer has a conveying unit configured to convey a sheet, a carriage configured to be movable in a scanning direction, the carriage mounting a printing head configured to eject ink drops to print an image on the sheet conveyed by the conveyor and a sensor configured to output a detection signal corresponding to absence and presence of the sheet, and a second controller. The first controller is configured to execute a generating process to generate margin information representing a margin width at an end portion, in the scanning direction, of the sheet on which an image represented by image data is to be printed, and a transmitting process to transmit the image data and the margin information to the inkjet printer. The second controller is configured to execute an obtaining process to obtain the image data and the margin information from the information processing device, a cueing process to cause the conveying unit to convey the sheet until the sheet reaches a position where an area of the sheet on which an image is to be printed firstly faces the printing head, a printing process to cause the printing head to eject ink drops, and in response to the margin width represented by the margin information being less than a threshold width, a detecting process to detect an actual position, in the scanning direction, of the sheet after the cueing process is finished based on the detection signal which is output from the sensor when the carriage is moved in the scanning direction prior to the printing process. The second controller causes the printing head to eject ink drops based on the actual position in the printing process after the detecting process is executed.

According to other aspects of the disclosures, there is provided an inkjet printer, which is provided with a communication interface configured to communicate with an information processing device, a conveyor configured to convey a sheet along a conveying direction, a printing head configured to eject ink drops to print an image on the sheet conveyed by the conveyor, a sensor configured to output a detection signal corresponding to absence and presence of the sheet, and a controller. The controller is configured to execute an obtaining process to obtain the image data and the margin information from the information processing device, a cueing process to cause the conveyor to convey the sheet until the sheet reaches a position where an area of the sheet on which an image is to be printed firstly faces the printing head, a printing process to cause the printing head to eject ink drops, and, in response to the margin width represented by the margin information being less than a threshold width, a detecting process to detect an actual position, in a scanning direction perpendicular to the conveying direction, of the sheet after the cueing process is finished based on the detection signal which is output from the sensor prior to the printing process. The controller causes the printing head to eject ink drops based on the actual position in the printing process after the detecting process is executed.

According to still further aspects of the disclosures, there is provided a non-transitory computer-readable recording medium storing instructions to be executed by a processor of a computer which is communicatable with an inkjet printer. The instructions, when executed by the processor, cause the processor to execute a generating process to generate unit image data representing a unit image of pieces of an image to be printed on the sheet by a recording head, of the inkjet printer, configured to eject ink drops to print the image on a sheet conveyed along a conveying direction and to generate unit margin information representing a margin width in a scanning direction, perpendicular to the conveying direction, of the sheet within a range of the unit image printed on the sheet, and stores the generated unit image data and the unit margin information in a storage provided to the computer in an associated manner, and a transmitting process to transmit the generated unit image data and the generated unit margin information stored in the storage in the associated manner to the inkjet printer through a communication interface provided to the computer. In the generating process, the processor generates minimum margin information representing a minimum value of a plurality of margin widths respectively represented by the plurality of pieces of unit margin information in response to generation of the plurality of pieces of unit image data and the plurality of pieces of the unit margin information constituting the image to be printed on the sheet by the recording head of the inkjet printer, and stores the minimum margin information in the storage. Further, in the transmitting process, in response to the minimum margin information being stored in the storage, the computer transmits the minimum margin information to the inkjet printer prior to transmitting the unit image data and unit margin information stored in the storage.

BRIEF DESCRIPTION OF THE ACCOMPANYING DRAWINGS

Figure 3:
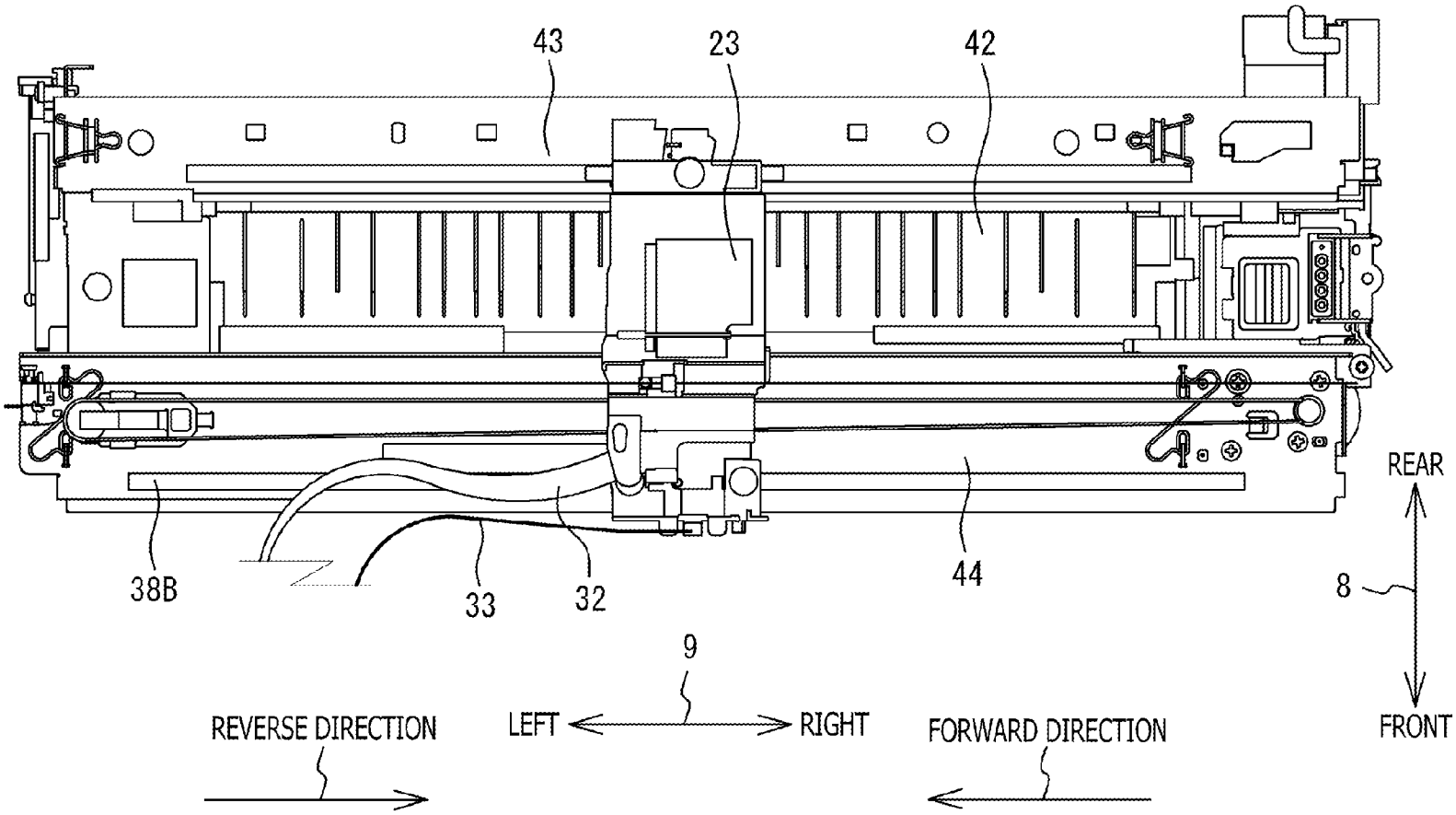

FIG. 3 a plan view of a carriage and guide rails 43 and 44 according to aspects of the disclosures.

Figure 4:
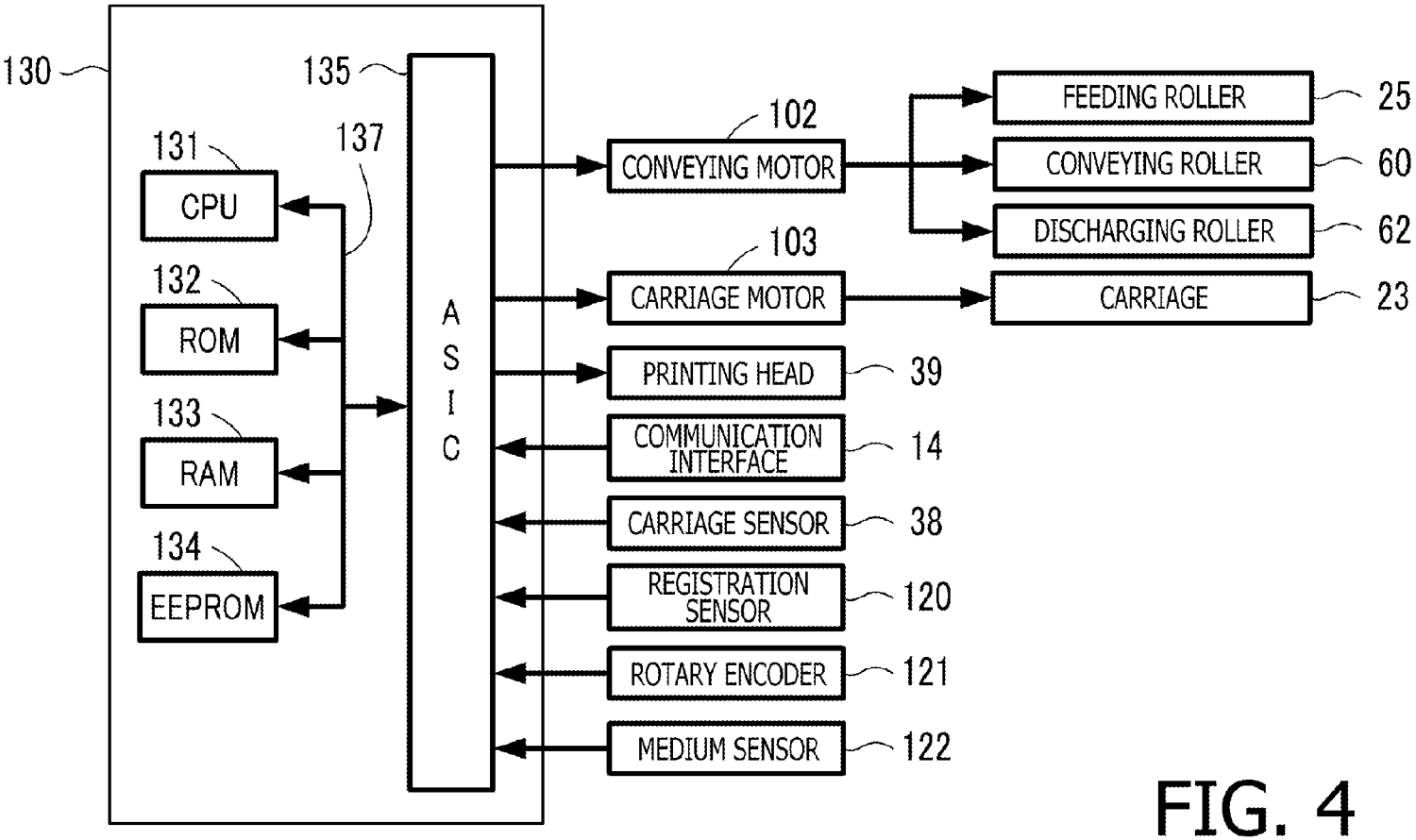

FIG. 4 is a block diagram of the printer unit according to aspects of the disclosures.

Figure 5A:
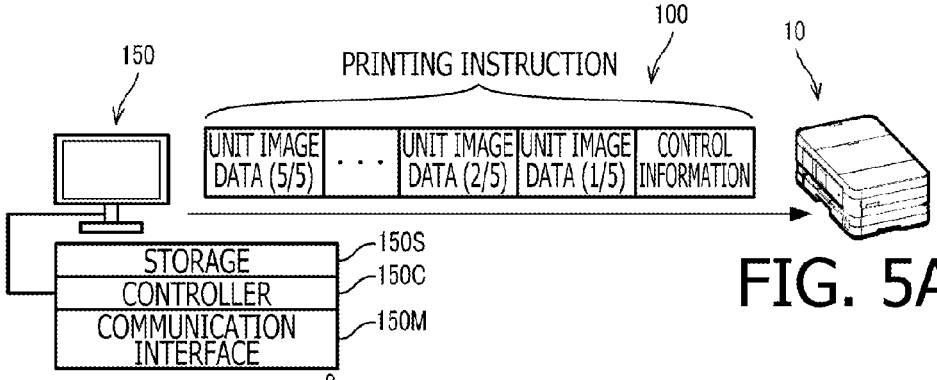

FIG. 5A schematically illustrates a data structure of a printing instruction transmitted from an information processing device to the MFP according to the illustrative embodiment.

Figure 5B:
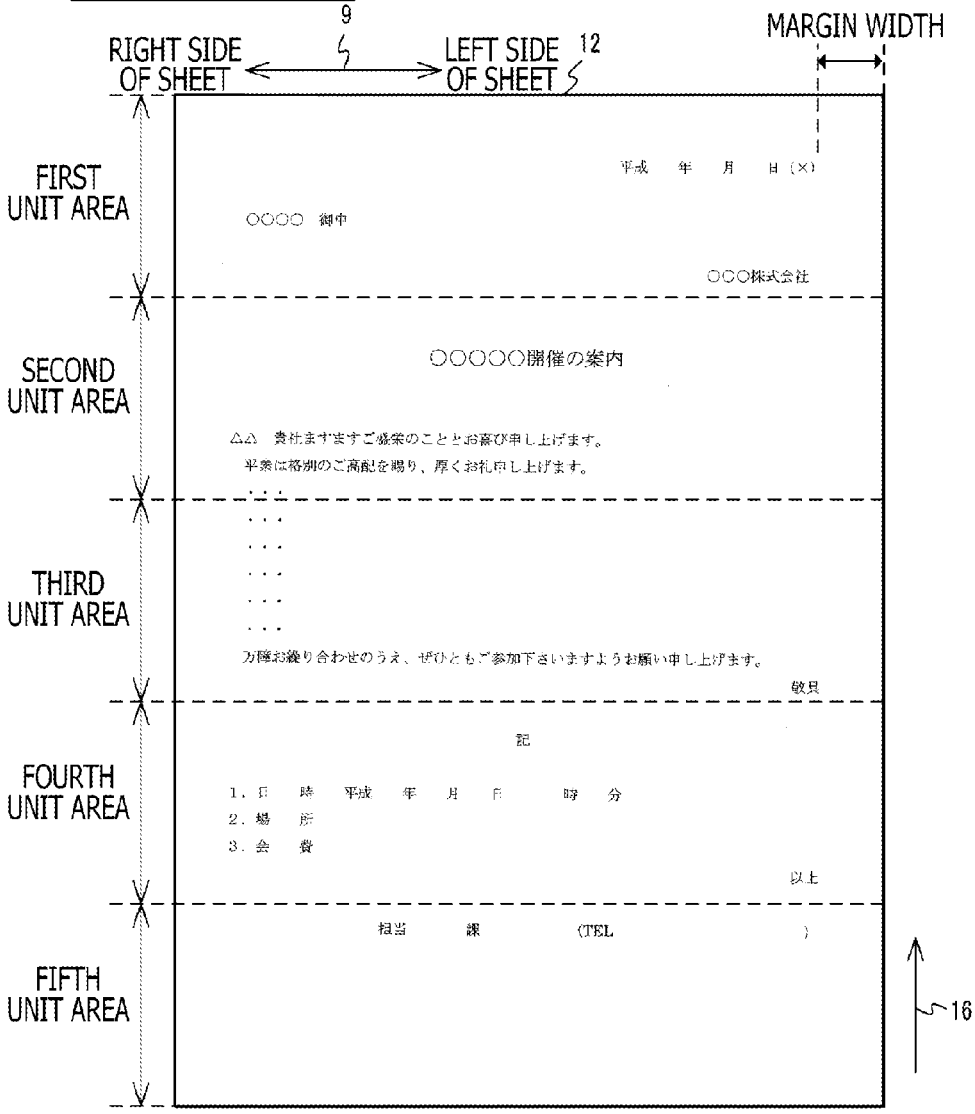

FIG. 5B schematically shows areas of an image represented by image data.

Figure 6:
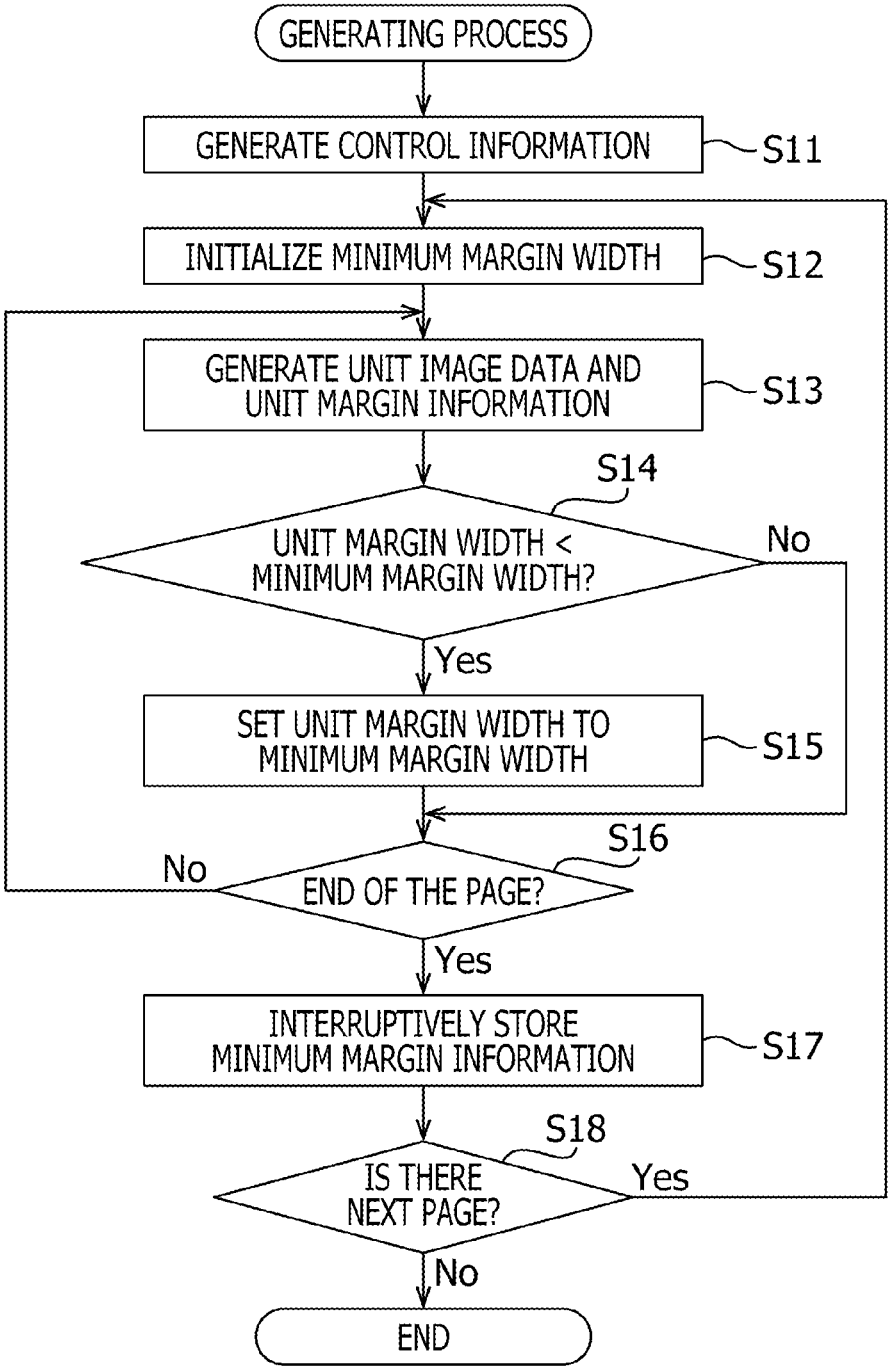

FIG. 6 is a flowchart illustrating a generation process according to the illustrative embodiment.

Figure 7:
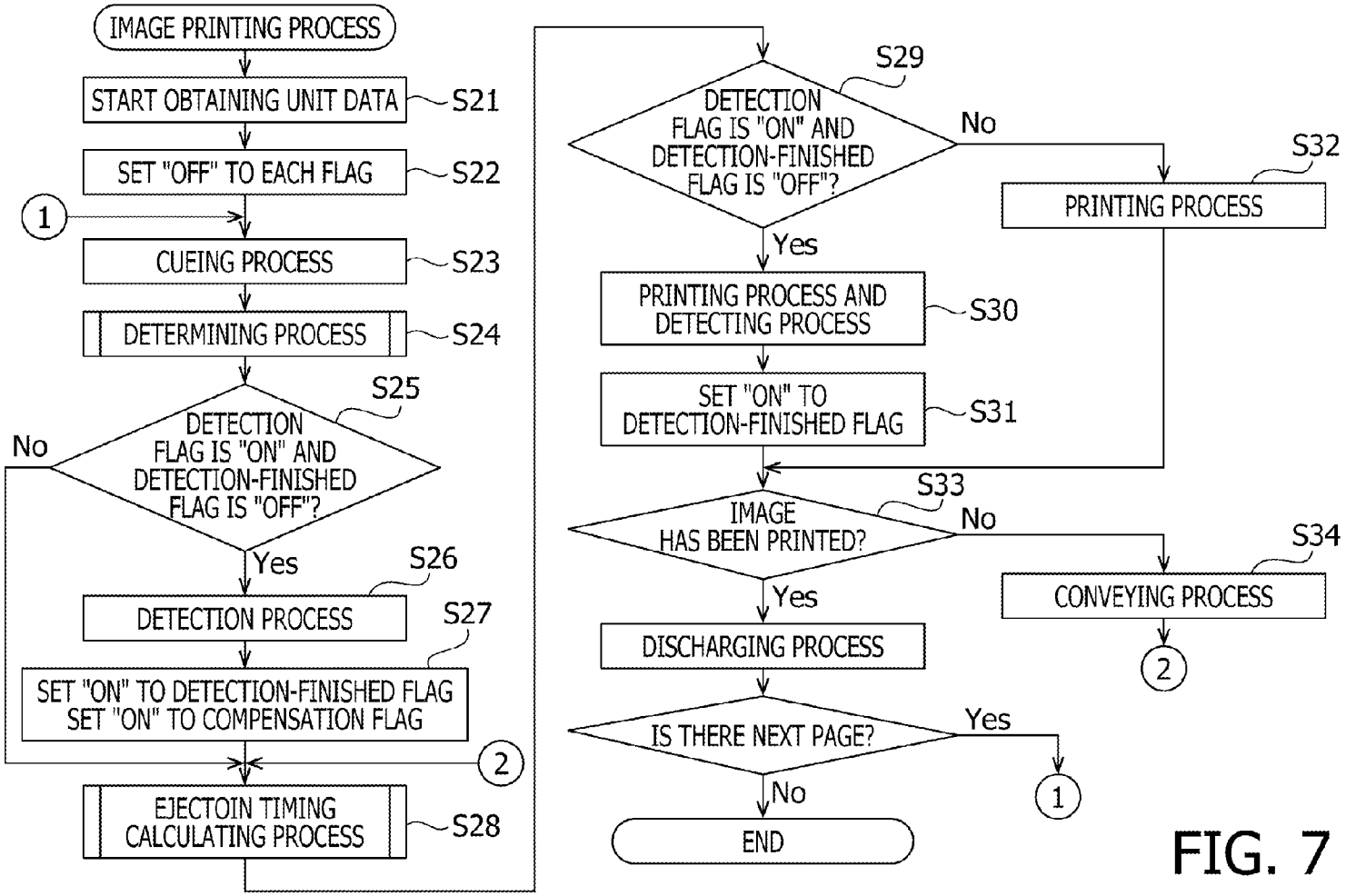

FIG. 7 is a flowchart illustrating an image printing process according to the illustrative embodiment.

Figure 8:
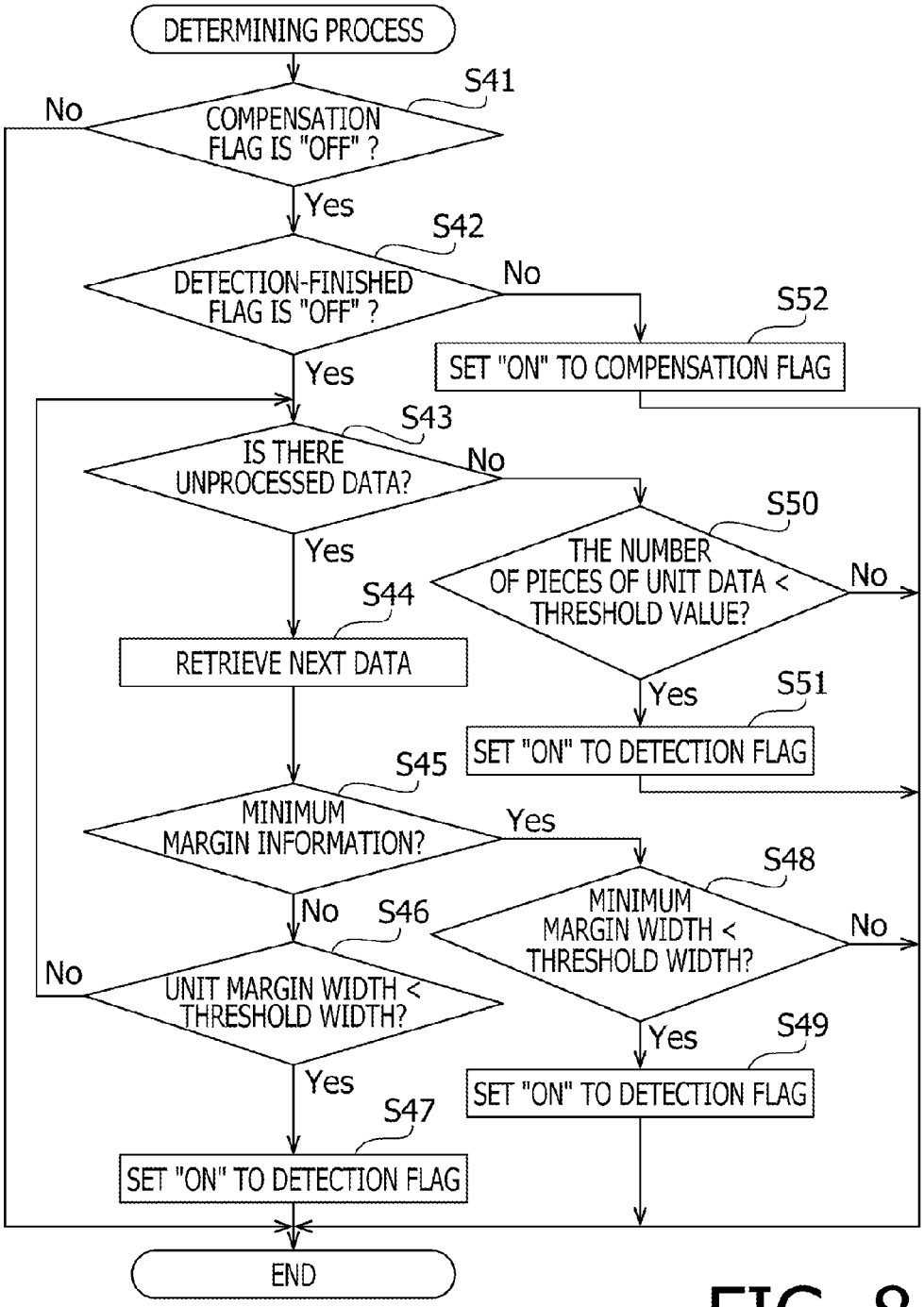

FIG. 8 is a flowchart illustrating a determining process according to the illustrative embodiment.

Figure 9:
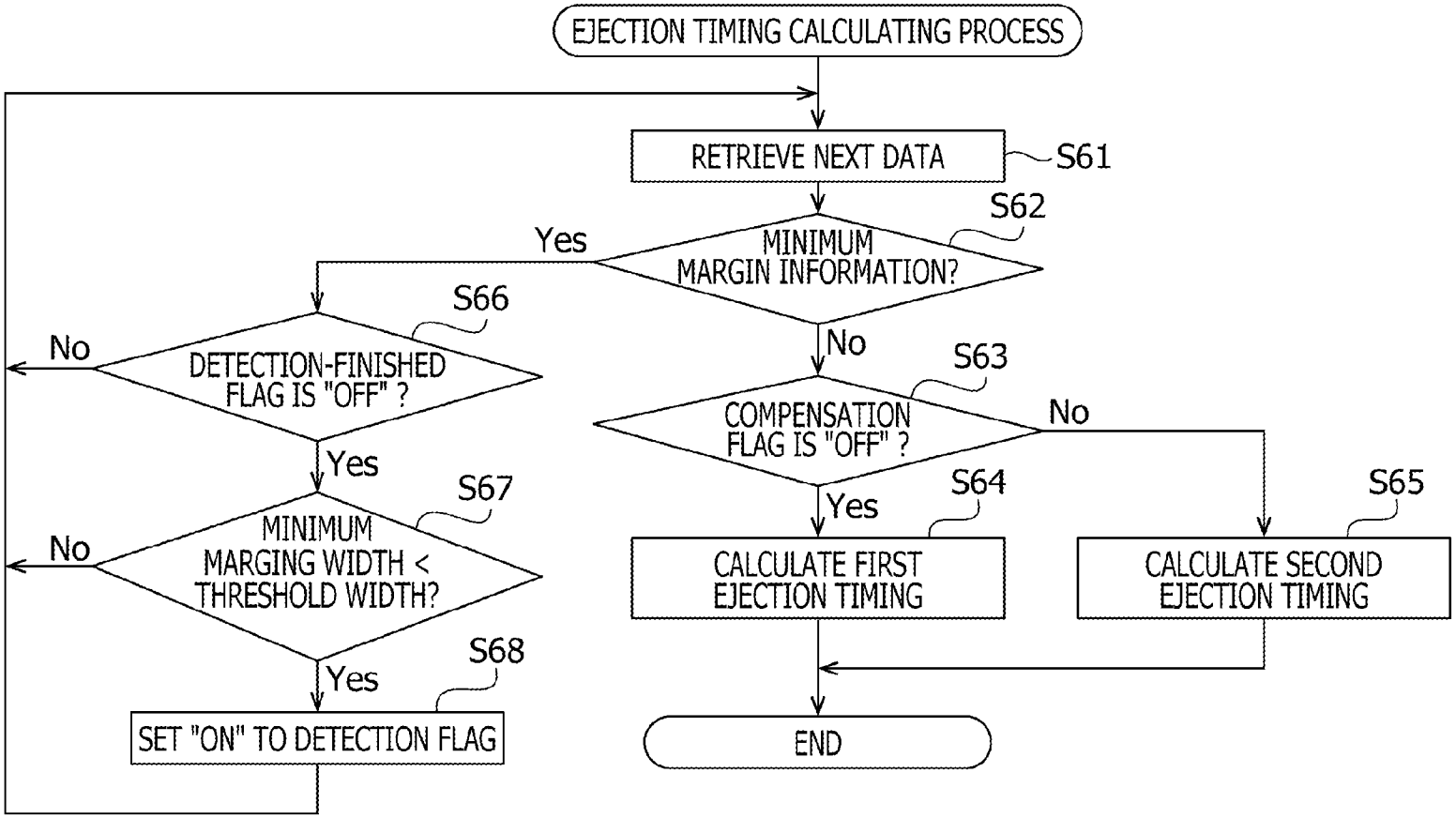

FIG. 9 is a flowchart illustrating an ejection timing calculating process according to the illustrative embodiment.

Figure 10A:
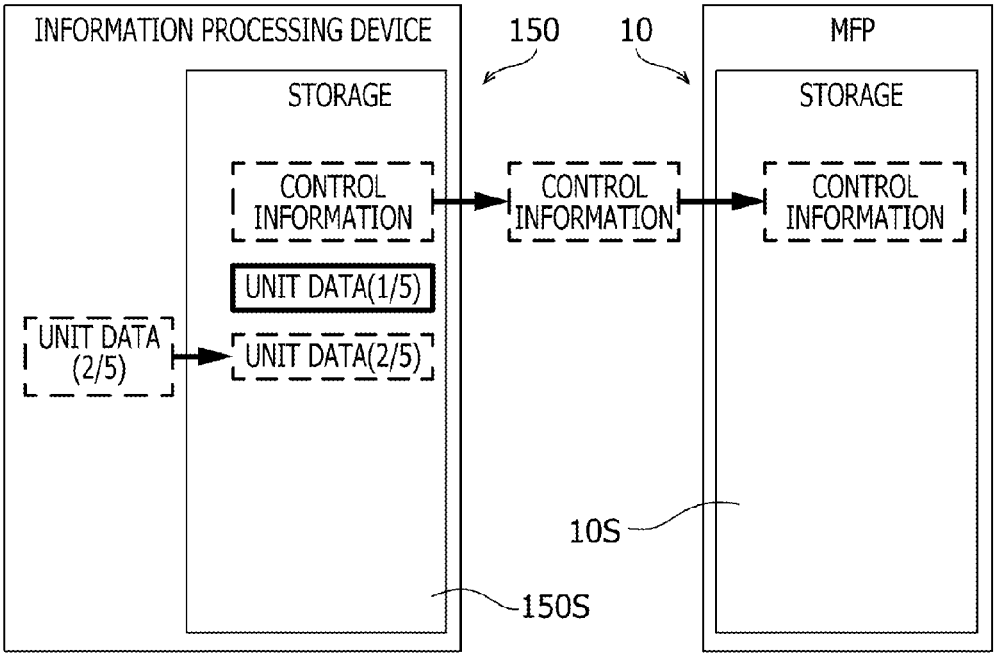

FIG. 10A schematically illustrates an exemplary status of a printing instruction where outputting of a control information is initiated.

Figure 10B:
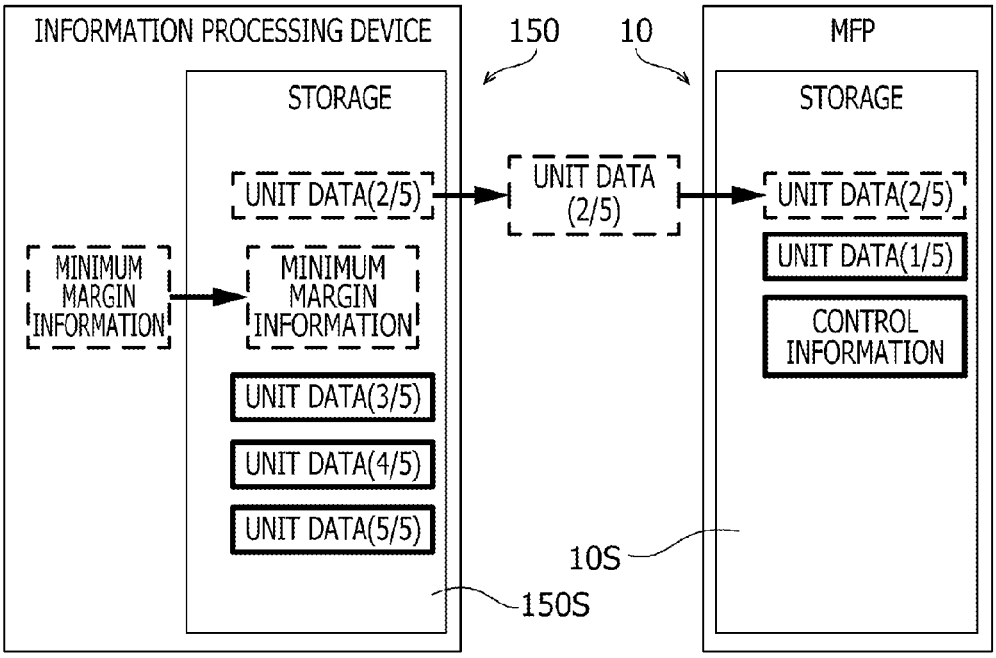

FIG. 10B schematically illustrates an exemplary status of the printing instruction where an interrupting step of storing minimum margin information is executed after unit data (2/5) is transmitted.

Figure 11A:
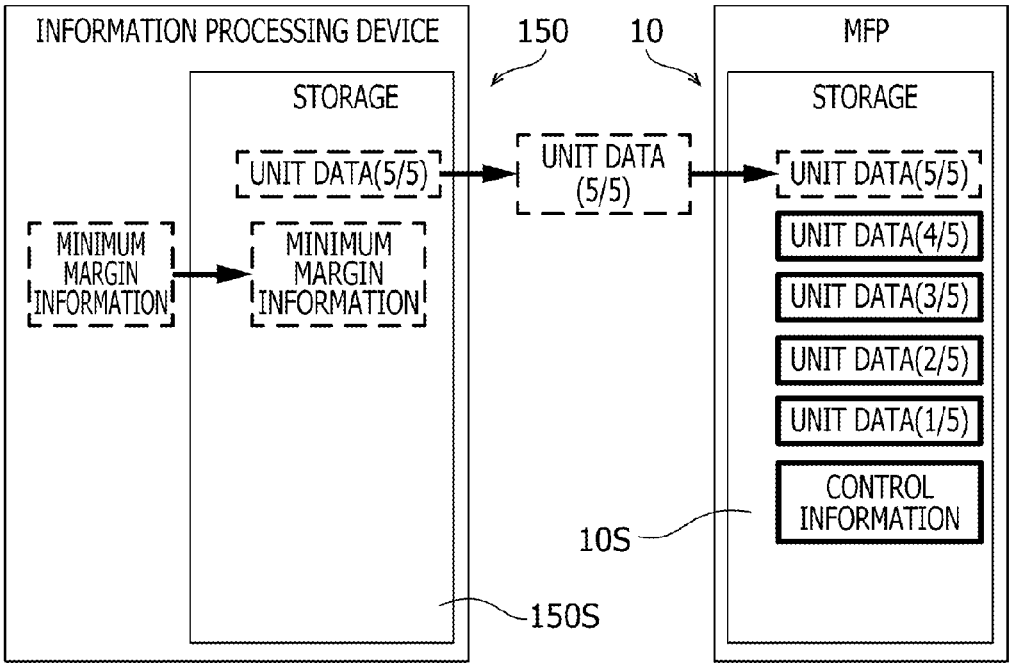

FIG. 11A schematically illustrates an exemplary status of the printing instruction where an interrupting step of storing minimum margin information is executed after unit data (5/5) is transmitted.

Figure 11B:
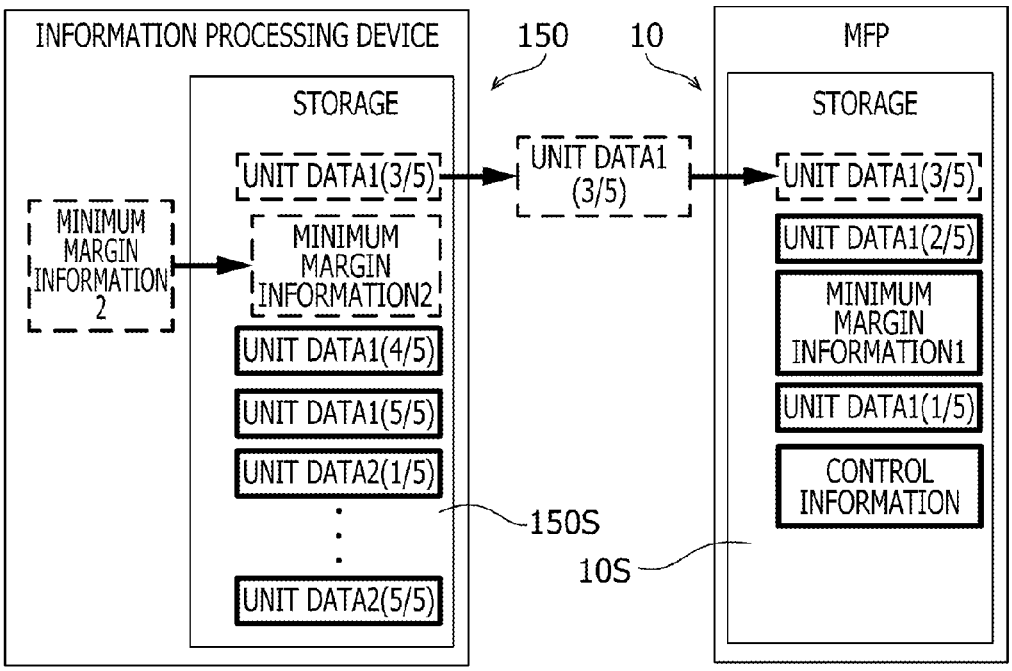

FIG. 11B schematically illustrates an exemplary status of the printing instruction where an interrupting step of storing minimum margin information 2 is executed after unit data 1(3/5) is transmitted.

DETAILED DESCRIPTION OF THE EMBODIMENT

Hereinafter, referring to the accompanying drawings, an illustrative embodiment according to aspects of the disclosures will be provided. It should be noted that the illustrative embodiment described hereinafter is merely an example and various modification may be realized without departing from the aspects of the disclosures.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Figure 1:
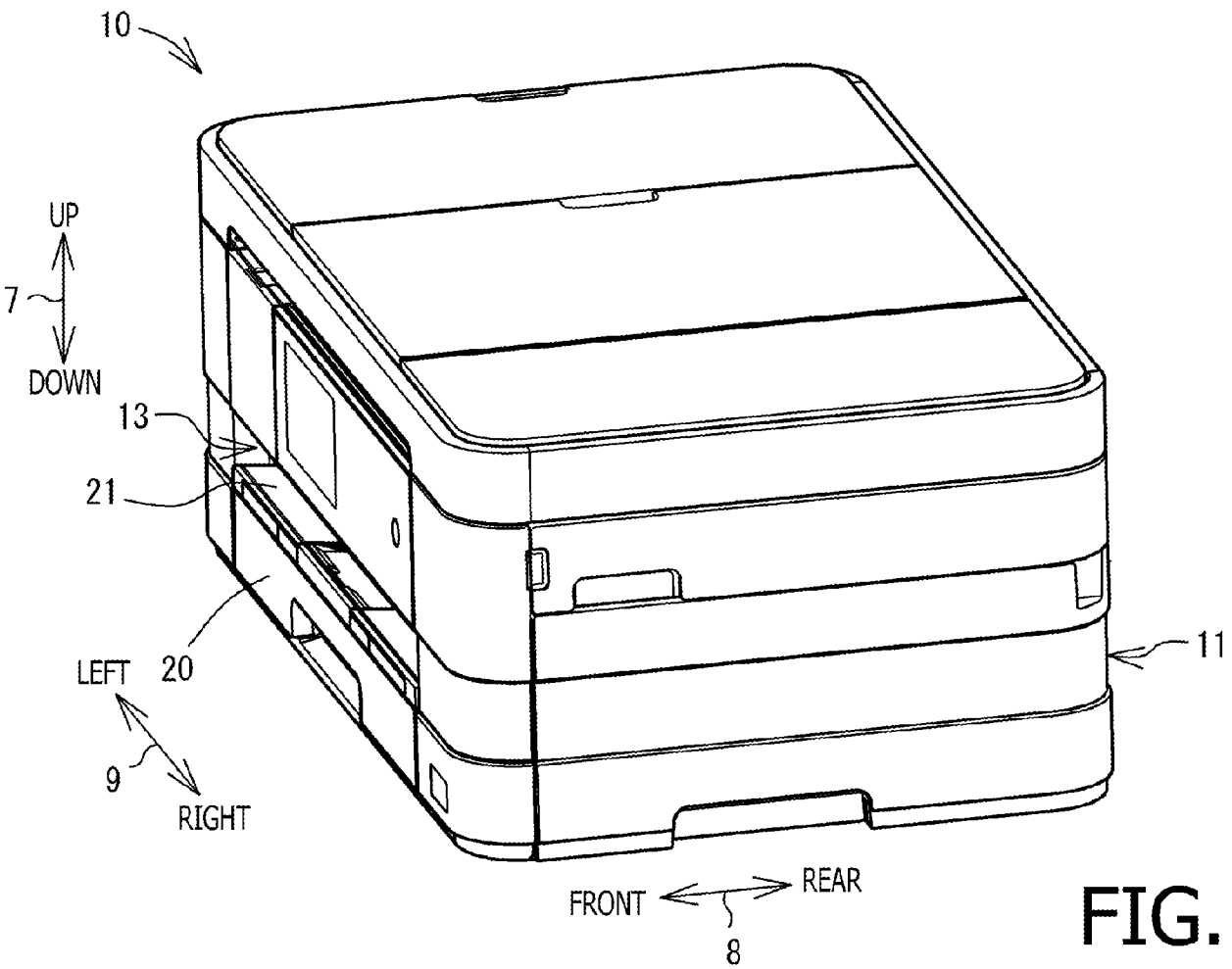
FIG. 1 is a perspective view of an MFP (multi-function peripheral) according to aspects of the disclosures.

In the following description and drawings, directions will be defined such that up and down directions are defined with respect an MFP (multi-function peripheral) 10 placed for use as shown in FIG. 1. Further, a direction on which an opening 13 is formed on a casing of the MFP 10 is defined as a front side of the MFP 10, an opposite side is defined as a rear side, and right and left sides when the MFP 10 is viewed from the front side are defined as right and left sides of the MFP 10, respectively. In the following description, an up-and-down direction 7, a front-and-rear direction 8 and a right-and-left direction 9 are defined based on the above definitions.

The MFP 10 has a substantially cuboids outer shape as shown in FIG. 1. The MFP 10 has a printer unit 11 provided on a lower part thereof. The printer unit 11 is configured to print images on sheets 12 in accordance with an inkjet printing method. Specifically, the printer unit 11 conveys the sheet 12 and ejects ink drops on the sheet being conveyed, thereby printing an image thereof. The printer unit 11 is, as shown in FIG. 2, provided with a feeding unit 14, a feeding tray 20, a discharging tray 21, a conveying roller unit 54, a printing unit 24, a discharging roller unit 55 and a platen 42.

As shown in FIG. 1, an opening 13 is formed on the front surface of the printer unit 11, and the feeding tray 20 is configured to be slidably attached to and removed from the printer unit 11 through the opening 13 by a user. The feeding tray 20 is configured to support a plurality of sheets 12 which are to be fed to a conveying path 65 by the feeding unit 15. The discharging tray 21 is arranged above the feeding tray 20. The discharging tray 21 supports the sheets 12 discharged by the discharging roller unit 55. According to the illustrative embodiment, the sheet 12 supported by the feeding tray 20 are aligned by a center aligning, which is an aligning of the sheets 12 such that the center, in the right-and-left direction 9, of the sheet 12 is aligned to coincide with the center, in the right-and-left direction 9, of the supporting surface of the feeding tray 20.

Figure 2:
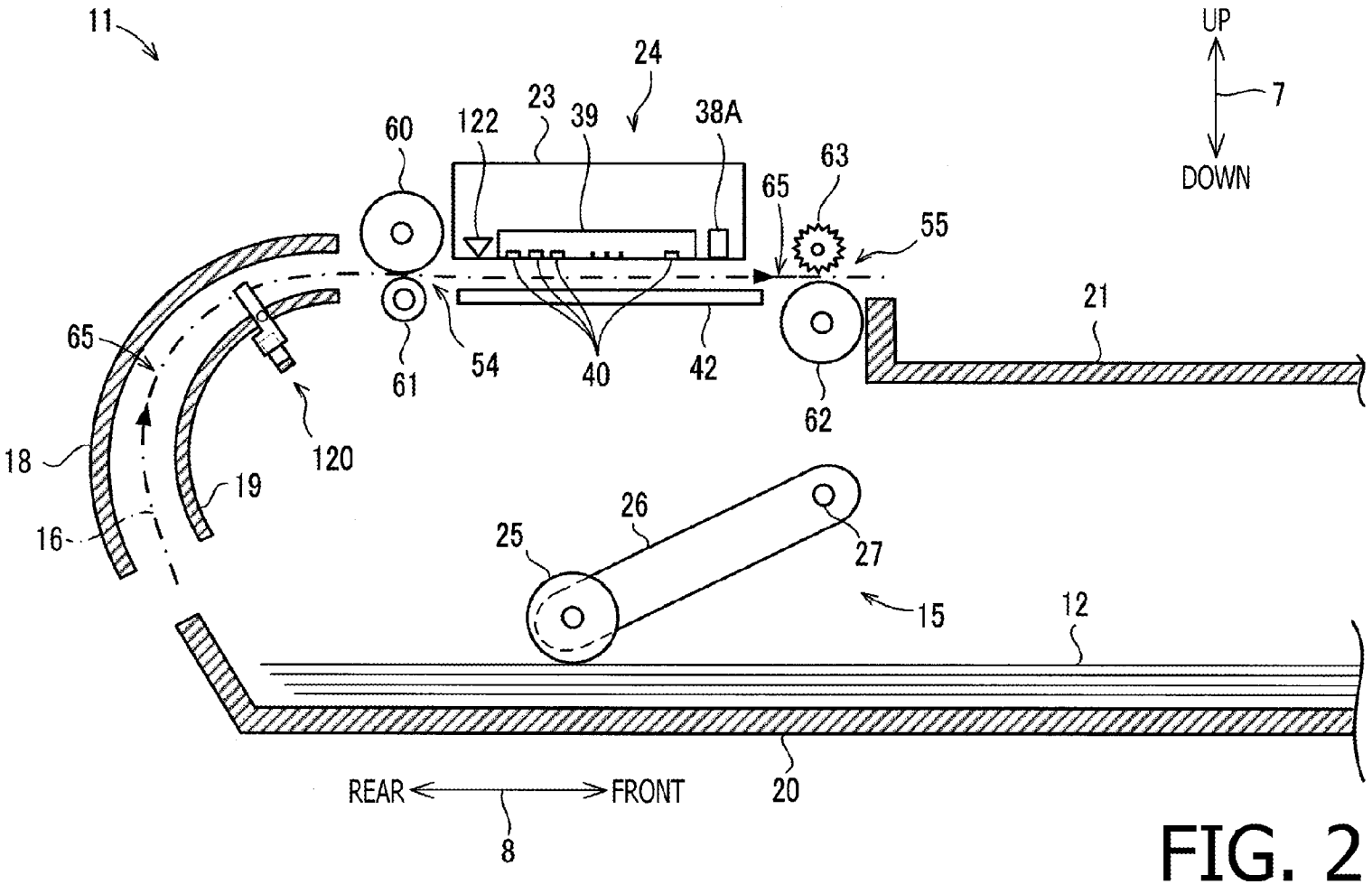
FIG. 2 is a cross-sectional side view showing main components inside a printer unit of the MFP shown in FIG. 1.

The feeding unit 15 is, as shown in FIG. 2, provided with a feeding roller 25, a feeding arm 26 and a shaft 27. The feeding roller 25 is rotatably supported at a tip end of the feeding arm 26. The feeding roller 25 is driven to rotate in a direction where the sheet 12 is fed in the conveying direction 16 as a feeding motor 102 (see FIG. 4) is reversely rotated. The feeding arm 26 is urged toward the feeding tray 20.

The conveying path 65 is a space, a part of which is defined by an outer guide member 18 and an inner guide member 19, which face each other with a predetermined distance therebetween, inside the printer unit 11 as shown in FIG. 2. The conveying path 65 extends from a rear end portion of the feeding tray 20 toward the rear end portion of the printing unit 24. The conveying path 65 is formed to make a U-turn at the rear end portion of the printer unit 11 from a lower side to an upper side, and further extends toward the discharging tray 21 via the printing unit 24. A sheet conveying direction 16 inside the conveying path 65 is indicated by a dotted line in FIG. 2.

The conveying roller unit 54 (an example of a conveyor) is arranged on an upstream side, in the conveying direction 16, with respect to the printing unit 24 as shown in FIG. 2. The conveying roller unit 54 is provided with a conveying roller 60 and a pinch roller 61 which face each other. The conveying roller 60 is driven to rotate by a conveying motor 102. The pinch roller 61 is driven by rotation of the conveying roller 60 to rotate. When the conveying motor 102 forwardly rotates, the sheet 12 nipped between the rotating conveying roller 60 and the pinch roller 61 is conveyed in the conveying direction 16.

The discharging roller unit 55 is arranged on a downstream side, in the conveying direction 16, with respect to the printing unit 24 as shown in FIG. 2. The discharging roller unit 55 is provided with a discharging roller 62 and a spur roller 63 which face each other. The discharging roller 62 is driven to rotate by the conveying motor 102. The spur roller 63 is driven by rotation of the discharging roller 62 to rotate. The sheet 12 nipped between the discharging roller 62 and the spur roller 63 is conveyed in the conveying direction 16 as the conveying motor 102 rotates forwardly.

The printer unit 11 is provided with a registration sensor 120 on the upstream side, in the conveying direction 16, with respect to the conveying roller unit 54. The registration sensor 120 is configured to output a low level signal, which is a detection signal, to a controller 130 of the MFP 10 (described later) in response to presence of the sheet 12 at a detection position, which is a position where the registration sensor 120 is arranged. The registration sensor 120 is also configured to output a high level signal, which is also a detection signal, in response to absence of the sheet 12 at the detection position, to the controller 130.

The printer unit 11 is provided with a well-known rotary encoder 121 configured to output a pulse signal synchronously with a rotation of the conveying roller 60, as shown in FIG. 4. The rotary encoder 121 is provided with an encoding disc and an optical sensor. The encoder disc is configured to rotate together with the conveying roller 60, while the optical sensor reads a predetermined pattern formed on the encoder disc and generates a pulse signal, which is transmitted to the controller 130.

The printing unit 24 is arranged between, in the conveying direction 16, the conveying roller unit 54 and the discharging roller unit 55, as shown in FIG. 2. The printing unit 24 is arranged to face a platen 42 in the up-and-down direction 7. The printing unit 24 is provided with a carriage 23, a printing head 39, an encoder sensor 38A, and a medium sensor 122.

From the carriage 23, an ink tube 32 and a flexible flat cable 33 extend, as shown in FIG. 3. The ink tube 32 is configured to supply ink contained in the ink cartridge to the printing head 39. The flexible flat cable 33 connects the controller substrate on which the controller 130 is arranged with the printing head 39.

The carriage 23 is supported by the guide rails 43 and 44 which are arranged at positions spaced from each other in the front-and-rear direction 8 as shown in FIG. 3. The carriage 23 is connected to a well-known belt mechanism provided to the guide rail 44. That is, the belt mechanism is provided with a driving pulley 47 arranged at an end portion, in the right-and-left direction 9, of the guide rail 44, a driven pulley 48 arranged at the other end portion, and a belt 49 wound around the driving pulley 47 and the driven pulley 48.

The carriage 23 is secured to the belt 49. As the carriage motor 103 (see FIG. 4) rotates, the driving pulley 47 rotates and causes the belt 49 to perform a round movement. Then, the carriage 23 reciprocally moves in the right-and-left direction 9 (also referred to as a scanning direction). Specifically, when the motor 103 forwardly rotates, the carriage 23 moves in a forward direction, which is a direction directed from the right end to the left end in the right-and-left direction 9. Further, when the motor 103 reversely rotates, the carriage 23 moves in a reverse direction, which is a direction directed from the left end to the right end, in the right-and-left direction 9, in FIG. 3.

The printing head 39 is mounted on the carriage 23 as shown in FIG. 2. On the lower surface of the printing head 39, a plurality of nozzles 40 are formed. The printing head 39 is configured to eject the ink through the nozzles 40 as minute ink drops. During movement of the carriage 23, the printing head 39 ejects the ink drops onto the sheet 12 supported by the platen 42, thereby an image being printed on the sheet 12.

The printing unit 24 executes a printing process to cause the printing head 39 to ejects the ink drops when the carriage 23 is moving in the forward direction or the reverse direction at least once, typically a plurality of times, to print an image on the sheet 12. In the present specification, an area of the sheet 12 on which an image is printed by one printing process will be defined as a unit area. As shown in FIG. 7, an entire area of the sheet 12 is divided into a plurality of unit areas which are next to each other in the conveying direction 16. In the example shown in FIG. 7, the entire area of the sheet 12 is divided into five unit areas, which will be referred to as first, second, third, fourth and fifth areas as indicated in FIG. 7. The printing unit 24 prints an image in the first to fifth areas in this order.

On the guide rail 44, a belt-like encoder strip 38B is attached. The encoder sensor 38A is mounted on the carriage 23 so as to face the encoder strip 38B. As the carriage 23 moves, the encoder sensor 38A reads the encoder strip 38B to generate a pulse signal, and transmits the pulse signal to the controller 130. The encoder sensor 38A and the encoder strip 38B constitute the carriage sensor 38.

The platen 42 is arranged between, in the conveying direction 16, the conveying roller unit 54 and the discharging roller unit 55 as shown in FIG. 2. The platen 42 is arranged to face, in the up-and-down direction 7, the printing unit 24, and is configured to support the sheet 12 having been conveyed by the conveying roller unit 54. According to the embodiment, a reflection index of the platen 42 is designed to be smaller than that of the sheet 12.

The medium sensor 122 is mounted on the carriage 23 as shown in FIG. 2. The medium sensor 122 has a light emitting unit and a light receiving unit. The light emitting unit is configured to emit light of which amount is controlled by the controller 130. The light emitted by the light emitting unit is reflected by the sheet 12 supported by the platen 42, or by the platen 42 itself if the sheet 12 is not supported thereon. The light receiving unit receives the reflected light. The medium sensor 122 is configured to transmit a detection signal representing the light amount of the received light to the controller 130. For example, the medium sensor 122 transmits the detection signal of a higher level as the light amount of the received signal is higher.

The MFP 10 has a communication interface 14 as shown in FIG. 4. The communication interface 14 is an interface to communicate with an information processing device 150 (see FIG. 5A) through a communication network. That is, the MFP 10 is capable of obtaining information from the information processing device 150 through the communication interface 14. The information processing device 150 needs not be a particular one, and could be a PC (personal computer), a smartphone, a tablet terminal and the like. The communication network needs not be limited to a particular one, and examples may be a wired LAN (local area network), a wireless LAN, or a combination thereof. Further, the communication unit 14 may be an interface having a cable such as a USB (universal serial bus) cable to be directly connected with an external device.

The controller 130 of the MAP 10 has, as shown in FIG. 4, a CPU (central processing unit) 131, a ROM (read only memory) 132, a RAM (random access memory) 133, an EEPROM (electrically erasable ROM) 134, and an ASIC (application specific integrated circuit) 135, which are interconnected through an inner bus 137. The ROM 132 stores programs causing the CPU 131 to control operations of respective components in the MFP 10. The RAM 133 is used as a temporary storage in which data and/or signals, which the CPU 131 uses when the CPU 131 executes the programs, are temporarily stored and/or used as a work area for data processing. The EEPROM 134 stores settings/parameters and flags to be retained after the MFP 10 is powered off.

To the ASIC 135, the conveying motor 102 and the carriage motor 103 are connected. The ASIC 135 obtains driving signals to rotate the conveying motor 102 and the carriage motor 103 from the CPU 131, and applies driving currents corresponding to the obtained driving signals to the conveying motor 102 and the carriage motor 103, respectively. Each motor is driven in accordance with the driving current from the ASIC 135 to forwardly or reversely rotate.

For example, the controller 130 controls the rotation of the conveying motor 102 to drive respective rollers. Further, the controller 130 drives the movement of the carriage motor 103 to reciprocally moves the carriage 23. Further, the controller 130 controls the printing head 39 to eject ink drops from the nozzles 40. Furthermore, the controller 130 obtains printing instruction from the external device through the communication interface 14.

The ASIC 135 is connected with the carriage sensor 38, the registration sensor 120, the rotary encoder 121 and the medium sensor 122. The controller 130 is configured to detect a position of the carriage 23 based on the pulse signal output by the carriage sensor 38. Further, the controller 130 is configured to detect the position of the sheet 12 based on the detection signal output by the registration sensor 120 and the pulse signal output by the rotary encoder 121. Further, the controller 130 is configured to detect side end positions of the sheet 12 in the right-and-left direction 9. The controller 130 (or the CPU 131) of the MFP10 is as an example of a second controller. The RAM133 and EEPROM 134 of the MFP10 are as an example of a second storage. The communication interface of the MFP 10 is as an example of a communication interface.

A printer system 100 according to the illustrative embodiment includes, as shown in FIG. 5A, the MFP 10 and the information processing device 150 which are mutually communicatable. The information processing device 150 includes a controller (e.g., one or more CPUs (central processing unit)) 150C, a storage 1505, and a communicating interface 150M. Hereinafter, referring to FIGS. 5A-11, a process in which the MFP 10 prints an image on the sheet 12 based on the printing instruction output by the information processing device 150 will be described. The controller 150C of the information processing device 150 is as an example of a first controller. The storage 1505 of the information processing device 150 is as an example of a first storage.

Firstly, referring to FIG. 6, a generating process executed by the information processing device 150 will be described. The generating process is executed, for example as the controller 150C retrieves a program therefor from the storage 150S and executes the same. The generating process is a process to generate a printing instruction. The printing instruction is for causing the MFP 10 to execute a printing process, which is a process of printing an image represented by image data on the sheet. The printing instruction includes, as shown in FIG. 5A, control information and the image data. Further, the image data is divided into a plurality of pieces of unit image data respectively representing unit images which are to be printed in the corresponding unit areas of the sheet 12.

In the following description, the plurality of pieces of unit image data to be printed on the first through fifth unit areas will be referred to as unit image data (1/5), unit image data (2/5), unit image data (3/5), unit image data (4/5) and unit image data (5/5), respectively. Further, margin information obtained from the unit image data (1/5), unit image data (2/5), unit image data (3/5), unit image data (4/5) and unit image data (5/5) will be referred to as unit margin information (1/5), unit margin information (2/5), unit margin information (3/5), unit margin information (4/5) and unit margin information (5/5), respectively. Further, all the unit image data (1/5), unit image data (2/5), unit image data (3/5), unit image data (4/5) and unit image data (5/5) will be collectively referred to as image data, and the corresponding unit image data and the unit margin information will be collectively referred to as unit data.

The generating process is executed by the information processing device 150 in response to a user's operation with respect to the information processing device 150 to cause the MFP 10 to start the image printing process. The printing instruction is generated in response to a generation instruction. The generation instruction includes target data which is subject to print. There is no need to limit the data format of the target data, and, for example, the target data is image data having JPEG (Joint Photographic Experts Group) format or the like, text data and PDF data.

Next, an example where the generation instruction including text data as depicted in FIG. 5B is input to the image processing device 150 will be described. Firstly, the controller 150C of the information processing device 150 generates control information in the generation process (S11). The controller 150 then stores the generated control information in the storage 150S of the information processing device 150. The control information includes, for example, the number of pieces of the unit data, information indicative of resolution of the image data and/or information indicative of the size of the sheets 12 on which images represented by the image data are to be printed. It is noted that the number of unit data represents the number of the unit data constituting the image printed on one sheet 12. Next, the controller 150C initializes the minimum margin width (S12). In S12, the information controller 150C may set a maximum value to a variable to which the minimum margin width is to be set.

Next, the controller 150C processes the target data and generates a plurality of pieces of unit image data and unit margin information from the target data (S13). That is, the controller 150C converts the target data, which is the text data in this example, to the plurality of pieces of unit image data in S13. Further, the controller 150C generates unit margin information based on the unit image data as converted. Furthermore, the controller 150C stores the plurality of pieces of unit image data and the plurality of pieces of unit margin data in the storage 150S in association with each other.

The unit image data is of a format which can be processed by the MFP 10 to print the image represented by the image data. For example, the unit image data is data for printing an image represented by the unit image data on the sheet 12. For example, the unit image data is so-called bit map data representing values of pixels which are arranged in a matrix to constitute each unit image. The values (i.e., pixel values) include a value representing that the pixel corresponding to the pixel value is white (hereinafter, such a pixel will be referred to as a white pixel) and/or a value representing that the pixel corresponding to the pixel value is not white (hereinafter, such a pixel will be referred to as a non-white pixel).

An example of generation of the unit margin information executed by the controller 150C will be described. The controller 150C counts rightward the number of white pixels from a left end of the unit image until the non-white pixel appears. The controller 150C also counts leftward the number of white pixels from a right end of the unit image until the non-white pixel appears. The above counting process is repeatedly executed for each of the rows, which correspond to each row of the image to be formed on the sheet 12 in the front-and-rear direction. Then, the controller 150C set the minimum number of the counted numbers of the white pixels to the unit margin information on the right/left sides of the unit image.

It is noted that any method for identifying the unit margin width can be employed. For example, instead of using the number of white pixels, a value defining a length itself may be used for identifying the unit margin width. Alternatively, the number of white pixels at each of the right and left sides (i.e., both side in the right-and-left direction) may be used as the unit margin information. Further alternatively, the smaller one of two numbers of the white pixels on right and left sides may be used as the unit margin information. For example, the unit margin information in the first unit area shown in FIG. 5B is information indicative of the length between the closing parenthesis ")" and the left end of the sheet 12 in the right-and-left direction 9.

Next, in response to the unit margin width is less than the minimum margin width (S14), the controller 150C sets the unit margin width to the minimum margin width (S15). That is, to the variable, to which the minimum margin width is to be set, the unit margin width calculated in S13 is set. When the unit margin width is equal to or more than the minimum margin width (S14: NO), the controller 150C proceeds to S16 without executing S15. Then, the controller 150C repeatedly executes S13-S15 (five times in the example of FIG. 5B) until all the pieces of unit data to be printed on one sheet 12 are generated (S16: NO).

The controller 150C starts outputting the printing instruction at a predetermined timing. For example, the generating process shown in FIG. 6 and the printing process of the printing instruction generated in the generating process are executed with parts thereof being overlapped. For example, in the example shown in FIG. 10A, the controller 150C outputs the control information stored in the storage 150S to the MFP 10 through the communication interface 150M of the information processing device 150 at a timing when the unit data (1/5) is stored in the storage 150S (i.e., at a timing when generation of the unit data (2/5) is started).

It is noted that, in FIG. 10A, data indicated by solid line within the storage 150S (i.e., the unit data (1/5)) is data which has been stored in the storage 150S. So is in a storage 10S of the MFP 10. It is noted that the storage 10S of the MFP10 is same as the RAM133, the EEPROM134, or both of the RAM133 and the EEPROM134. Data indicated by broken lines is data of which the transmitting process is being executed (i.e., the control information) or data to which the generating process is executed (i.e., the unit data (2/5)). Data indicated by the broken lines in the storage 10S (i.e., the control information) represents data of which an obtaining process is being executed. So are in FIG. 10B, FIG. 11A and FIG. 11B.

The controller 150C of the information processing device 150 interruptively stores the minimum margin information representing the minimum margin width in the storage 150S of the information processing device 150 (S17) in response to generation of the unit data for one page (S16: YES). It is noted that the controller 150C manages the output order of the data stored in the storage 150S (i.e., the control information, the unit data and the minimum margin information). The control information and the unit data are output to the MFP 10 in the order of generation (i.e., in the stored order in the storage 150S of the information processing device 150). The minimum margin information is output before the unit data which will be output next. In other words, the minimum margin information is output after the currently output control information or unit data is output. That is, the controller 150C outputs the minimum margin information to the MFP 10 before the unit data, which has already been stored in the storage 150S when S17 is executed, is output.

The controller 150C interruptively stores the minimum margin information before the unit data (3/5) in S17, which is executed when the unit data (2/5) is being output, as shown in FIG. 10B. That is, in the example shown in FIG. 10B, the controller 150C transmits, to the MFP 10, the control information, the unit data (1/5), the unit data (2/5), the minimum margin information, the unit data (3/5), the unit data (4/5) and the unit data (5/5) in this order. It is noted that any method of managing the output order can be used. For example, a method of using a first arrangement storing respective pieces of data and a second arrangement storing indexes of the elements in the first arrangement in the output order may be employed.

The controller 150C repeatedly executes S12-S17 until all the pages of the target data include in the generation instruction are printed (S18: YES). In response to completion of printing of all the pages of the target data (S18: NO), the controller 150C terminates the generating process. It is noted that the output order shown in FIG. 10B is only an example, and the order could vary depending on a relationship between execution speed of the generating process (i.e., the processing speed of the CPU of controller 150C of the information processing device 150) and an execution speed of the transmitting process (i.e., a communication speed between the information processing device 150 and the MFP 10).

For example, FIG. 11A shows a case where the execution speed of the output process is higher in comparison with a case shown in FIG. 10B, with respect to the execution speed of the generation process. In the example shown in FIG. 11A, at a time when S17 is executed, the output process of the unit data (5/5) has already been started. That is, in the example shown in FIG. 10B, the controller 150C outputs the minimum margin information after the unit data (5/5) is output.

For another example, FIG. 11B shows a case where the execution speed of the output process is slower, in comparison with a case shown in FIG. 10B, with respect to the execution speed of the generation process. In the example shown in FIG. 11B, minimum margin information 1 is generated during the output process of the unit data 1(1/5) of the first page, and minimum margin information 2 is generated before transmitting process of the unit data 1(3/5) of the first page is finished. That is, the controller 150C outputs the minimum margin information 1 for the first page after the unit data 1(1/5) of the first page is transmitted, in the example shown in FIG. 11B. Further, the controller 150C outputs minimum margin information 2 for the second page after the unit data 1(3/5) for the first page is transmitted in the example shown in FIG. 11B. It is noted that the indication of "unit data 1" means the unit data for the first page. Other indications having a number "1" at the end of the name of the data/information such as "minimum margin information 1" means that the data/information is for the first page. Similarly, the indication such as "unit data 2" means the "unit data" of the second page.

It is noted that, in the generating process, the controller 150C also generates a conveying command instruction a conveying amount in a conveying process (S34) which will be described in detail later and a discharging command representing a conveying amount in a discharging process (S35) which will be described later. It is noted that such commands are the same as those of conventional art. Therefore, according to the present disclosures, only the control information, the unit data and the minimum margin information will be described.

Next, referring to FIG. 7, the image printing process executed by the controller 130 of the MFP 10 will be described. The image printing process is executed by the CPU 131 of the controller 130. It is noted that each of processes described below may be executed such that the CPU 131 retrieves a program stored in the ROM 132 and executes the same, or each process may be realized by a hardware circuit implemented to the controller 130. In the following description, the printing process will be explained with focusing mainly on rotations of the feeding roller 25, the conveying roller 60 and the discharging roller 62, and a movement of the carriage 23. The rotations of the rollers are realized by driving the conveying motor 102, and the movement of the carriage 23 is realized by driving the carriage motor 103.

The printing process shown in FIG. 7 is started in response to input of the printing instruction from the information processing device 150 is input in the MFP 10. The controller 130 of the MFP 10 executes the printing process shown in FIG. 7 in response to obtaining of the control information included in the printing instruction from the information processing device 150 through the communication interface 14. When the printing process is started, the controller 130 firstly starts obtaining the unit data (S21). That is, the controller 130 obtains the unit data subsequently transmitted from the information processing device 150 through the communication interface 14, and stores the obtained unit data in the RAM 133, EEPROM 134, or both of the RAM133 and EEPROM134 which is as the storage 10S of the MFP 10.

The controller 130 sets a value of "OFF" to a detection flag, a detection-finished flag and a compensation flag (S22). The detection flag represents whether an execution condition for starting the detecting process is satisfied or not. An initial value of the detection flag is "OFF," and the detection flag is set to "ON" when the execution condition is satisfied. The detection-finished flag represents whether the detecting process has been executed or not. An initial value of the detection-finished flag is "OFF," and is set to "ON" when the detecting process is executed. The compensation flag represents whether the result of the detecting process is to be reflected in the ejection timing calculating process. An initial value of the compensation flag is "OFF" and is set to "ON" at a timing where the result of the detecting process is to be reflected in the ejection timing calculating process.

The controller 130 executes a cueing process (S23). The cueing process is a process of conveying the sheet 12 to a position at which an area on which an image is initially printed faces the printing head 39. According to the illustrative embodiment, the controller 130 firstly feeds one of the sheets 12 in the feeding tray 20 by rotating the feeding roller 25 until the leading end of the sheet 12 reaches the conveying roller unit 54. Next, the controller 130 rotates the conveying roller 60 and the discharging roller 62 until the sheet 12 is further conveyed and the unit area on which an image is firstly printed reaches a position to face the printing head 39. The position of the leading end of the sheet 12 can be identified based on a combination of the change of the signal value output by the registration sensor 120 and the pulse signal output by the rotary encoder 121. It is noted that the cueing process is executed in parallel with an obtaining process (S21).

In S24, the controller 130 execute a determining process (S24) which is a process of determining whether an execution condition of the detection process (S26) is satisfied. The controller 130 executes the determining process based on, for example, the unit data or the minimum margin information stored in the storage 10S of MFP 10 at the time when the cueing process is completed.

Next, referring to FIG. 8, the determining process will be described in detail. The controller 130 executes S43 onwards when "OFF" is set to both the compensation flag and the detection finished flag (S41: YES; S42: YES). When data (i.e., the unit data or the minimum margin information), which have been obtained from the information processing device 150, and for which steps S45 onwards have not been executed are stored in the storage 10S (S43: YES), the controller 130 retrieves data to be retrieved next from the storage 10S (S44). It is noted that the order of retrieving the data in S44 coincides with the order in which the data was stored in the storage 10S (i.e., the order in which the data was obtained from the information processing device 150). The method of managing the retrieving order may be similar to the management method of the outputting order as mentioned above (see FIG. 6).

Next, when the data retrieved in S44 is the unit data (S45: NO), the controller 130 executes steps S46 onwards. Firstly, when the unit margin width, which is represented by the unit margin information included in the unit data, is less than the threshold width (S46: YES), the controller 130 sets "ON" to the detection flag, and terminates the determining process (S47). That is, when the unit margin width is less than the threshold width (S46: YES), the execution condition for the detecting process is satisfied. When the unit margin width is equal to or greater than the threshold width (S46: NO), the controller 130 executes steps S43 onwards again. In this case, the unit data retrieved in S44 is kept retained in the storage 10S.

When the data retrieved in S44 is the minimum margin information (S45: YES), the controller 130 executes steps S48 onwards. Firstly, when the minimum margin width represented by the minimum margin information is less than the threshold width (S48: YES), the controller 130 sets "ON" to the detection flag and terminates the determining process (S49). That is, when the minimum margin width is less than the threshold width (S48: YES), the execution condition for the detecting process is satisfied. When the minimum margin width is equal to or greater than the threshold width (S48: NO), the controller 130 terminates the determining process without executing S49. That is, when the minimum margin width is equal to or greater than the threshold width (S48: NO), the execution condition for the detecting process is not satisfied. It is noted that the minimum margin information retrieved in S44 is deleted from the storage 10S.

When no data is stored in the storage 10S or S44-S49 have been executed for all the pieces of data stored in the storage 10S (S43: NO), the controller 130 executes steps S50 onwards. Firstly, when the number of the pieces of the obtained unit data is less than the threshold value (S50: YES), the controller 130 sets "ON" to the detection flag and terminates the determining process (S51). That is, when the number of pieces of the obtained unit data is less than the threshold value (S50: YES), the execution condition for the detecting process is satisfied. When the number of pieces of the obtained unit data is equal to or greater than the threshold value (S50: NO), the controller 130 terminates the determining process without executing S51. That is, when all the unit margin widths are equal to or greater than the threshold width (S46: NO) and the number of pieces of the unit data already obtained is equal to or greater than the threshold value (S50: NO), the execution condition for the detecting process is not satisfied.

It is noted that the threshold width referred to in S46 and S48 is, for example a value having been stored in advance in the ROM 132. For example, in the ROM 132, a plurality of threshold widths X1, X2, X3, . . . Xn (in this case, Xn represents the number of pixels) may be stored in association with a plurality of resolutions D1, D2, D3, . . . Dn, respectively. Then, the controller 130 can obtain the threshold width Xn corresponding to the resolution Dn which is included in the control information. The threshold value used in S50 is determined, for example, by multiplying the number of pieces of the unit data included in the control information with a predetermined threshold ratio. In the following description, it is assumed that that the number of pieces of the unit data is five, and the predetermined threshold ratio is 50% (i.e., the threshold value=5×0.5=2.5).

For example, FIG. 10B shows a state where the control information and the unit data (1/5) have been stored in the stored 10S when the cueing process is finished. In this case, regardless whether the unit margin width represented by the unit margin information (1/5) is less than the threshold width (S46: YES) or not less than the threshold width (S46: NO; S43: NO; S50: YES), a value "ON" is set to the detection flag (S47 or S51).

According to another example, FIG. 11A shows a state where the control information and the unit data (1/5)-(4/5) have been stored in the storage 10S when the cueing process is completed. In this case, if one of the unit margin widths respectively represented by the unit margin information (1/5)-(4/5) is less than the threshold width (S46: YES), the value "ON" is set to the detection flag (S47). If all of the unit margin widths respectively represented by the unit margin information (1/5)-(4/5) are not less than the threshold value (S46: NO; S43: NO; S50: NO), the value "OFF" of the detection flag is retained.

According to still another example, FIG. 11B shows a state where the control information, unit data 1(1/5), minimum margin information 1, unit data 1(2/5) have been stored in the storage 10S. In this case, when the unit margin width represented by the unit margin information 1(1/5) is less than the threshold width (S46: YES) or the minimum margin width is less than the threshold width (S48: YES), the value "ON" is set to the detection flag (S47, S49). When the unit margin width represented by the unit margin information 1(1/5) and the minimum margin width are not less than the threshold width (S46: NO; S48: NO), the value "OFF" of the detection flag is retained. It is noted that the unit margin information 1(2/5) is not used in the determining process in the example shown in FIG. 11B.

When a value "OFF" is set to the compensation flag and a value "ON" is set to the detection-finished flag (S41: YES; S42: NO), the controller 130 sets "ON" to the compensation flag and terminates the determining process (S52). When "ON" is set to the compensation flag (S41: NO), the controller 130 terminates the determining process. The above processes are executed only when images are printed on a plurality of pages, and detailed description will be provided later.

In FIG. 7, when "ON" is set to the detection flag and "OFF" is set to the detection-finished flag (S25: YES), the controller 130 executes the detecting process (S26). That is, the detecting process is executed when the execution condition for the detecting process is satisfied and the detecting process has not been executed.

The detecting process is a process of detecting positions of the ends, in the right-and-left direction 9, of the sheet 12 conveyed to a position to face the printing head 39 by the cueing process. In the following description, the positions of the ends of the sheet 12 will be referred to as the actual end positions. For example, the controller 130 moves the carriage 23 in the right-and-left direction 9 with causing a light emitting unit of the medium sensor 122 to emit light and a light receiving unit to receive reflected light to generate a detection signal. The controller 130 detects the positions at which the changing amount of the detection signal output from the medium sensor 122 is equal to or greater than a predetermined threshold amount as the actual end positions of the sheet 12, and stores information identifying the actual end positions of the sheet 12 in the storage 10S. It is noted that the actual end positions may be identified by, for example, encoder values of the carriage sensor 38.

In response to execution of the detecting process, the controller 130 sets "ON" to the detection-finished flag and the compensation flag (S27). When the detection flag is set to "OFF" or when the detection-finished flag is set to "ON" (S25: NO), the controller 130 proceeds to S28. Thus, steps S26 and S27 are not executed when the execution condition of the detecting process is not satisfied or the detecting process has already been executed.

By repeatedly executing S28-S34, the controller 130 prints the image on the sheet 12. Firstly, the controller 130 executes an ejection timing calculation process (S8). The ejection timing calculation process is a process of calculating a timing at which the controller 130 causes the printing head 39 to eject each ink drop to impact on a position on the sheet 12 corresponding to a non-white pixel. Hereinafter, such a position on the sheet 12 to which the ink drop is to impact will be referred to as an impact position. In the ejection timing calculation process according to the illustrative embodiment, ejection timings for the ink drops which are ejected to a unit area on which an image is printed next.

Referring to FIG. 9, the ejection timing calculating process will be described in detail. The controller 130 retrieves data to be retrieved next from the storage 10S (S61). The order of retrieval of the data stored in the storage 10S is common with the order of retrieval in S44. Then, when the data retrieved in S61 is the unit data (S62: NO), the controller 130 executes S63 onwards. Firstly, when the compensation flag is set to "OFF" (S63: YES), the controller 130 calculates the first ejection timing and terminates the ejection timing calculation process (S64). When the compensation flag is set to "ON" (S63: NO), the controller 130 calculates the second ejection timing and terminates the ejection timing calculating process (S65).

In the ejection timing calculation process according to the illustrative embodiment, the ink ejection position of the printing head 39 (or the nozzles 40) is calculated as an ejection timing. An ink drop which is ejected from the printing head 39 at a calculated timing (i.e., when the printing head 39 has reached a position corresponding to the calculated timing) reaches a desired impact position on the sheet 12.

The first ejection timing is an ejection timing at which a unit image represented by the unit image data retrieved in S61 is printed on the sheet 12 which is located at a reference position in the right-and-left direction 9. The reference position is defined as a position of the sheet 12 facing the printing head 39 at which both ends, in the right-and-left direction 9, of the sheet 12 are respectively located at predetermined positions. Accordingly, the reference position is defined for each of the plurality of sheet sizes. The second ejection timing is an ejection timing at which a unit image represented by the unit image data retrieved in S61 is printed on the sheet 12 which is located at the actual position in the right-and-left direction. The ejection position at the second ejection timing is displaced from the ejection position at the first ejection timing in a direction, with respect to the reference position, directed to the actual position by a distance which is the same as a distance between the reference position and the actual position in the right-and-left direction 9.

The controller 130 executes S66 onwards in response to retrieval of the minimum margin information in S61 (S62: YES). When "OFF" is set to the detection-finished flag (S66: YES) and when the minimum margin width is less than the threshold width (S67: YES), the controller 130 sets "ON" to the detection flag (S68) and executes S61 onwards again. When the minimum margin width is not less than the threshold width (S67: NO), the controller 130 executes S61 onwards again. When "ON" is set to the detection-finished flag (S66: NO), the controller 130 executes S61 onwards again. It is noted that, when the minimum margin width is not less than the threshold width (S67: NO), the controller 130 does not executed S68. Further, when "ON" is set to the detection-finished flag (S66: NO), the controller 130 does not executed S67 or S68. A case where S66-S68 are executed will be described later.

As shown in FIG. 7, when "ON" is set to the detection flag and "OFF" is set to the detection-finished flag (S29: YES), the controller 130 executes the printing process and the detecting process (S30), and sets "ON" to the detection-finished flag (S31). When "OFF" is set to the detection flag or "ON" is set to the detection-finished flag (S29: NO), the controller 130 executes the printing process (S32). It is noted that the printing process in S30 and S32 is a process where the controller 130 moves the carriage 23 in the forward direction or the reverse direction, and causes the printing head 39 to eject the ink at the ejection timing calculated in the ejection timing calculating process. By one execution of the printing process, an image represented by the unit image data is printed within one unit area of the sheet 12.

It is noted that the controller 130 executes the detecting process in the printing process at S30. That is, the controller 130 controls the carriage motor to 103 to move the carriage 23, in the right-and-left direction 9, with medium sensor 122 emitting the light. The controller 130 further causes the printing head 39 to eject ink drops at each ejection timing, and detects position at which a changing amount of the detection signal output by the medium sensor 122 is equal to or greater than a threshold changing amount as the actual positions of the sheet 12. Then, the controller 130 stores information representing the detected actual positions, for example, in the storage 10S. Before executing the printing process at S30, the controller 130 controls the carriage motor 103 to move the carriage 23 at a position where the medium sensor 122 passes above the end positions of the sheet 12.

Next, when image printing on the sheet 12 has not been finished (S33: NO), the controller 130 executes a sheet conveying process (S34). The sheet conveying process is a process of conveying the sheet 12 in the conveying direction 16 until the unit area on which an image is printed during the next printing process reaches a position at which the unit area faces the printing head 39. That is, the controller 130 causes the conveying roller 54 and the discharging roller 55 to convey the sheet 12 by a predetermined line feed amount in the conveying direction 16.

The controller 130 repeatedly executed S28-S34 until printing of an image onto the sheet 12 is finished (S33: YES). When the printing of the image is finished (S33: YES), the controller 130 executes the discharging process (S35) to discharge the sheet 12, on which the image has been printed, on to the discharge tray 21. That is, the controller 130 drives the conveying roller unit 54 and the discharge roller unit 55 until the sheet 12 is discharged on the discharge tray 21. The controller 130 executes S23-S35 repeatedly until all the images included in the printing instruction are printed (S36: YES). When all the images included in the printing instruction have been printed (S36: NO), the controller 130 terminates the image printing process.

For example, in the example shown in FIG. 11B, the controller 130 executes the ejection timing calculation process and the printing process for each piece of the unit data 1(1/5)-(3/5). That is, the controller 130 executes S28-S34 three times. It is noted that, when the minimum margin width represented by the minimum margin information 1 is equal to or greater than the threshold width, the controller 130 calculate the first ejection timing in each execution of the ejection timing calculating process (S64), and the controller 130 does not executes the detecting process (S32). When the printing process for the unit data 1(3/5) has been finished, "OFF" is set to each of the detection flag, the detection-finished flag and the compensation flag.

Next, the controller 130 retrieves the minimum margin information 2 in the ejection timing calculating process (S61, S62: YES), and when the minimum margin width represented by the minimum margin information 2 is less that the threshold width (S67: YES), the controller 130 sets "ON" to the detection flag. Next, the controller 130 retrieves the unit data 1(4/5) (S61, S62: NO) and calculates the ejection timing of the unit image data 1(4/5) as the first ejection timing (S64). Thereafter, since "ON" is set to the detection flag (S29: YES), the controller 130 executes the detecting process (S30) during the printing process of the unit image data 1(4/5) and sets "ON" to the detection-finished flag (S31).

Next, during the ejection timing calculating process, the controller 130 retrieves the unit image data 1(5/5) (S61, S62: NO). At this stage, since the detecting process is executed in the previously executed printing process (S30) but the compensation flag is still set to "OFF" (S63: YES), the controller 130 calculates the first ejection timing (S64) as the ejection timing for the unit image data 1(5/5). Further, since the detection-finished flag is set to "ON" (S29), the controller 130 does not execute the detecting process in the printing process of the unit image data 1(5/5) (S32).

The controller 130 discharges the sheet 12 on which the images represented by the unit image data 1(1/5)-(5/5) have been printed (S35), and executes the cueing process for the next sheet 12 (S23). At this stage, since "OFF" is set to the compensation flag (S41: YES) and "ON" is set to the detection-finished flag (S42: NO), the controller 130 sets "ON" to the compensation flag and terminates the determining process (S52). That is, the controller 130 calculates the second ejection timing (S65) during the ejection timing calculating process for the unit image data 2(1/5)-(5/5). That is, the results of the detecting process executed during the printing process for the first sheet 12 is reflected in the printing process for the second sheet.

When an image has relatively large margin widths, even in the printing position with respect to the sheet 12 is displaced in the right-and-left direction 9, the user may not have discomfort feeling. Therefore, as described above, the MFP 10 according to the illustrative embodiment does not executed the detecting process when the margin width is equal to or greater than the threshold width. With this configuration, lowering of the throughput in the image printing process can be suppressed. In contrast, if an image having relatively small margins is printed on the sheet 12 with shifted in the right-and-left direction 9, the user may easily have the discomfort feeling. Therefore, the MFP 10 according to the illustrative embodiment is configured to calculate the second ejection timing for printing the image of the sheet 12 located at the actual position when the margin width is less than the threshold width. With this configuration, user's discomfort feeling of deteriorated quality of the image due to displacement of the image in the right-and-left direction 9 can be suppressed.

According to the MFP 10 described above, when the cueing process is completed, the determining process is executed based on the unit data and minimum margin information stored in the storage 10S. Therefore, within a time range which does not include a waiting time after the cueing process is completed, whether the detecting process is necessary or not can be determined based on the maximum number of pieces of unit margin information at that stage. As a result, lowering of the throughput in image printing process can be suppressed.

In the MFP 10 according to the illustrative embodiment, when the number of pieces of the unit data (specifically, unit margin information) that can be obtained when the cueing process is finished is relatively small, the detecting process is executed regardless of the comparison of the unit margin width with the threshold width. As a result, when the communication speed between the information processing device 150 and the MFP 10 is relatively fast, user's feeling of the deterioration of quality of the printed image can be suppressed. Even when the communication speed is relatively slow, affection in the throughput by execution of the detecting process is relatively small.

According to the MFP 10 described above, since the minimum margin information is given priority in transmitting/receiving, even if the unit image data for an entire page has not been obtained, whether the detecting process is necessary or not can be determined based on the minimum margin width. As a result, the user's subjective deterioration of the image quality can be effectively suppressed.

It is noted that the displacement of the sheets 12 in the right-and-left direction 9 may typically occur since the sheets 12 are supported by the sheet feed tray 20 with being displaced in the right-and-left direction 9. In such a case, the displaced amount of the sheets 12 in the right-and-left direction is common among the plurality of sheets which are subsequently fed. In consideration of such a situation, according to the MFP 10 described above, when "ON" is set to the detection-finished flag, the detecting process will not be executed again. With such a configuration, the number of execution of the detecting process during the image printing process shown in FIG. 7 is utmost once. Accordingly, the subjective deterioration of the image quality can be suppressed, and further lowering of the throughput in image printing process can also be suppressed.

According to the MFP 10 described above, when the detecting process is determined to be unnecessary in the determining process, and the detecting process is determined to be necessary when S28-S34 are repeatedly executed, the detecting process is executed during the printing process. The result of such a detecting process is not reflected to the page being subjected to print, and reflected to the next page. Thus, in the example of FIG. 11B, such a result is not reflected on the first page, but reflected in printing on the second page. With this configuration, the user's subjective deterioration of image printing quality and lowering of the throughput in image printing process can be suppressed.

In the above-described illustrative embodiment, a case where the detecting process is executed in the printing process (S30) immediately after "ON" was set to the detection flag during the ejection timing calculating process is described. It is noted that an execution timing of the printing process (S30) associated with the detecting process needs not be the above-described one. For example, the controller 130 may execute the detecting process during the printing process in which the carriage 23 is moved to a closest position to the end of the movable range of the carriage 23, among the printing processes for the first page, which have not yet been executed when the minimum margin information is retrieved in S66. With such a configuration, a superfluous movement of the carriage 23 for executing the detecting process can be minimized, and thus lowering of the throughput in the image printing process can further be suppressed.

For example, assuming that the unit data 1(4/5)-(5/5) have been stored in the storage 10S when the minimum margin information 2 is retrieved in S61 in the example shown in FIG. 11B, the controller 130 executes the detecting process during the printing process with respect to the unit image data 1(4/5) which is associated with the minimum unit margin width, from among the unit data 1(4/5)-(5/5) stored in the storage 10S. Alternatively, the image processing device 150 may incorporate information indicating for which of printing processes for the unit image data 1(4/5)-(5/5) the detecting process is to be executed in the minimum margin information 2. In such a case, the controller 130 may execute the printing process associated with the detecting process based on the above information incorporated in the minimum margin information 2.

According to the above-described illustrative embodiment, the results of the detecting process (i.e., the actual position of the sheet 12) is reflected in the ejection timing calculating process. It is noted that usage of the results of the detecting process needs not be limited to such a case. That is, the controller 130 can cause the printing head to eject the ink drops based on the actual position in the printing process after the detecting process is executed.

For example, when the length of the sheet 12, in the right-and-left direction 9, identified by the end position detected in the detecting process is shorter than the length, in the right-and-left direction 9, of the image represented by the image data, the controller 130 may control the printing head 39 so as not eject the ink drops for the non-white pixels which are represented by the image data but will be arranged outside the sheet 12. With such a control, it is possible to prevent the ink drops from impacting the outside of the sheet 12 (e.g., typically, on the platen 42). It is noted that, if the margin width is relatively large, even if the size of the sheet 12 is smaller than the size of the image, a possibility that the ink drops reach outside the sheet 12. In such a case, the detecting process and the ejection control process may be omitted.

What is claimed is:

1. A printer system including an information processing device and an inkjet printer, the information processing device comprising a first controller, and the inkjet printer comprising:

a conveyor configured to convey a sheet;

a carriage configured to be movable in a scanning direction, the carriage mounting a printing head configured to eject ink drops to print an image on the sheet conveyed by the conveyor and a sensor configured to output a detection signal corresponding to absence and presence of the sheet; and a second controller, wherein the first controller is configured to execute:

a generating process to generate margin information representing a margin width at an end portion, in the scanning direction, of the sheet on which an image represented by image data is to be printed; and a transmitting process to transmit the image data and the margin information to the inkjet printer, and wherein the second controller is configured to execute:

an obtaining process to obtain the image data and the margin information from the information processing device;

a cueing process to cause the conveyor to convey the sheet until the sheet reaches a position where an area of the sheet on which an image is to be printed firstly faces the printing head;

a printing process to cause the printing head to eject ink drops; and in response to the margin width represented by the margin information being less than a threshold width, a detecting process to detect an actual position, in the scanning direction, of the sheet after the cueing process is finished based on the detection signal which is output from the sensor when the carriage is moved in the scanning direction prior to the printing process, wherein the second controller causes the printing head to eject ink drops based on the actual position in the printing process after the detecting process is executed.

2. The printer system according to claim 1, wherein the second controller is configured to execute an ejection timing calculating process in which a first ejection timing and a second ejection timing are calculated, wherein the first ejection timing is calculated in response to the detecting process not having been executed, the first ejection timing being a timing at which the ink drops are to be ejected to print the image on the sheet located at a reference position in the scanning direction, wherein the second ejection timing is calculated in response to the detecting process having been executed, the second ejection timing being a timing at which the ink drops are to be ejected to print the image on the sheet located at the actual position in the scanning direction, and wherein the second controller causes, during the printing process, the printing head to eject the ink drops at a timing calculated in the ejection timing calculating process.

3. The printer system according to claim 2, wherein the information processing device comprises a first storage, and wherein the inkjet printer comprises a second storage, wherein the first controller is configured to:

generate unit image data representing a unit image to be printed on the sheet when the carriage moves from one end to the other end in the scanning direction, and unit margin information representing a margin width of the unit image on the sheet, and store the generated unit image data and the generated unit margin information in the first storage in an associated manner in the generating process; and transmit the unit image data and the unit margin information which are stored in the first storage in the associated manner to the inkjet printer in the transmitting process, the first controller executing the generating process and the transmitting process in parallel and repeatedly, and wherein the second controller is configured to:

store the unit image data and the unit margin information obtained from the information processing device in the obtaining process in the second storage; and execute the detecting process in response to the margin width, which is represented by one of a plurality of pieces of the unit margin information having been stored in the second storage when the cueing process, which is executed in parallel with the obtaining process, being less than the threshold width.

4. The printer system according to claim 3, wherein, in the transmitting process, the first controller transmits a number of pieces of unit data representing the number of pieces of the unit image data constituting the image to be printed on the sheet to the inkjet printer prior to transmitting first pieces of the unit image data and the unit margin information to the inkjet printer, and wherein, in the obtaining process, the second controller obtains the number of pieces of unit data from the information processing device, and executes the detecting process in response to a ratio of the number of pieces of the unit margin information stored in the second storage with respect to the number of pieces of the unit data is less than a predetermined threshold ratio.

5. The printer system according to claim 3, wherein, in the generating process, the first controller generates minimum margin information representing a minimum value of a plurality of margin widths respectively represented by the plurality of pieces of unit margin information in response to generation of the plurality of pieces of unit image data and the plurality of pieces of the unit margin information constituting the image to be printed on the sheet, and stores the minimum margin information in the first storage, and wherein, in the transmitting process, in response to the minimum margin information being stored in the first storage, the first controller transmits the minimum margin information to the inkjet printer prior to transmitting the unit image data and unit margin information stored in the first storage.

6. The printer system according to claim 5, wherein, in the obtaining process, the second controller stores the minimum margin information obtained from the information processing device in the second storage, and wherein the second controller executes the detecting process when the minimum margin information has been stored in the second storage when the cueing process has been finished and in response to the minimum margin information represented by the minimum margin information being less than the threshold width.

7. The printer system according to claim 6, wherein, when the image is printed on a first sheet and a second sheet in series, first, the image is printed on the first sheet by repeatedly executing a retrieving process, the printing process and a conveying process by the second controller, wherein the retrieving process is to retrieve, in a predetermined order, the plurality of pieces of the unit image data and the minimum margin information stored in the storage, wherein the ejection timing calculating process and the printing process are executed with respect to the unit image data in response to the unit image data being retrieved in the retrieving process, wherein the conveying process is to cause the conveyor to convey the sheets until an area of the sheet on which an image is printed in the printing process reaches a position to face the printing head, wherein, when the minimum margin information is retrieved during the retrieving process when an image is being printed on the first sheet, and in response to the margin width represented by the minimum margin information being less than the threshold width, the second controller executes the detecting process in the printing process executed for the first sheet, and wherein the second controller calculates the second ejection timing in the ejection timing calculating process for the second sheet.

8. The printer system according to claim 7, wherein the second controller executes the detecting process in one printing process in which the carriage is moved to a position closest to an end portion of a movable range of the carriage, the one printing process being one of the printing processes which are for the first sheet and have not been executed when the minimum margin information is retrieved in the retrieving process.

9. The printer system according to claim 1, wherein the first controller is configured to generate, in the generating process, the margin information representing a smaller one of the margin widths at both end portions, in the scanning direction, of the sheet on which the image is printed.

10. The printer system according to claim 1, wherein the second controller executes the detecting process once at a maximum during a process of printing the image represented by the image data.

11. The printer system according to claim 1, wherein, in the detecting process, the second controller detects at least one of both actual edge positions as the actual position, in the scanning direction, of the sheet, and wherein the second controller causes the printing head to eject ink drops based on the actual edge position in the printing process after the detecting process is executed.

12. The printer system according to claim 1, wherein, in the detecting process, the second controller detects both actual edge positions as the actual position, in the scanning direction, of the sheet, and wherein the second controller causes the printing head to eject ink drops based on both the actual edge positions in the printing process after the detecting process is executed.

13. An inkjet printer, comprising:

a communication interface configured to communicate with an information processing device;

a conveyor configured to convey a sheet along a conveying direction;

a printing head configured to eject ink drops to print an image on the sheet conveyed by the conveyor;

a sensor configured to output a detection signal corresponding to absence and presence of the sheet; and a controller configured to execute:

an obtaining process to obtain the image data and the margin information from the information processing device;

a cueing process to cause the conveyor to convey the sheet until the sheet reaches a position where an area of the sheet on which an image is to be printed firstly faces the printing head;

a printing process to cause the printing head to eject ink drops; and in response to the margin width represented by the margin information being less than a threshold width, a detecting process to detect an actual position, in a scanning direction perpendicular to the conveying direction, of the sheet after the cueing process is finished based on the detection signal which is output from the sensor prior to the printing process, wherein the controller causes the printing head to eject ink drops based on the actual position in the printing process after the detecting process is executed.

14. The inkjet printer according to the claim 13, further comprising a carriage configured to be movable in the scanning direction, wherein the sensor is mounted on the carriage, and wherein, in the detecting process, the controller detects the actual position of the sheet based on the detection signal from the sensor when the carriage is moved in the scanning direction.

15. The inkjet printer according to the claim 14, wherein the printing head is mounted on the carriage.

16. A non-transitory computer-readable recording medium storing instructions to be executed by a processor of a computer which is communicatable with an inkjet printer, the instructions, when executed by the processor, causing the processor to execute:

a generating process to generate unit image data representing a unit image of pieces of an image to be printed on the sheet by a recording head, of the inkjet printer, configured to eject ink drops to print the image on a sheet conveyed along a conveying direction and to generate unit margin information representing a margin width in a scanning direction, perpendicular to the conveying direction, of the sheet within a range of the unit image printed on the sheet, and stores the generated unit image data and the unit margin information in a storage provided to the computer in an associated manner, and a transmitting process to transmit the generated unit image data and the generated unit margin information stored in the storage in the associated manner to the inkjet printer through a communication interface provided to the computer;

wherein, in the generating process, the processor generates minimum margin information representing a minimum value of a plurality of margin widths respectively represented by the plurality of pieces of unit margin information in response to generation of the plurality of pieces of unit image data and the plurality of pieces of the unit margin information constituting the image to be printed on the sheet by the recording head of the inkjet printer, and stores the minimum margin information in the storage, and wherein, in the transmitting process, in response to the minimum margin information being stored in the storage, the computer transmits the minimum margin information to the inkjet printer prior to transmitting the unit image data and unit margin information stored in the storage.

* * * * *